United States Patent [19]

Grass

[11] Patent Number: 4,881,826

[45] Date of Patent: Nov. 21, 1989

[54] UNDER-BASE GUIDING SYSTEM FOR A DRAWER

[75] Inventor: Alfred Grass, Höchst, Austria

[73] Assignee: Alfred Grass Ges.m.b.H. Metallwarenfabrik, Hochst/Blbg., Austria

[21] Appl. No.: 206,506

[22] Filed: Jun. 14, 1988

[30] Foreign Application Priority Data

Apr. 7, 1988 [AT] Austria ..... 906/88

[51] Int. Cl.[4] ..... A47B 88/00

[52] U.S. Cl. ..... 384/19; 312/341.1

[58] Field of Search ..... 384/18–23; 312/341 R, 342, 345, 330 R, 343, 344, 351

[56] References Cited

U.S. PATENT DOCUMENTS

| | | | |
|---|---|---|---|
| 3,275,396 | 9/1966 | Hillson et al. | 384/18 X |
| 3,375,051 | 3/1968 | Anderson | 312/343 |
| 3,387,907 | 6/1968 | Wall | 312/341 R X |
| 3,966,273 | 6/1976 | Hagen et al. | 312/345 X |
| 4,176,890 | 12/1979 | Gorton | 312/341 R X |
| 4,199,200 | 4/1980 | Livingston | 384/19 |
| 4,412,703 | 11/1983 | Simonson | 312/341 R X |

*Primary Examiner*—Thomas R. Hannon

[57] ABSTRACT

An under-base guiding system for a drawer of a piece of furniture is described, wherein the body of the piece of furniture is provided with sidewalls, a front batten, and rails having guide rollers, and wherein the drawer is provided with rails having guide rollers.

The body rails are situated below the base of the drawer, and are secured to the front batten of the body by a front connector and to the rear wall of the body by a rear connector. The drawer rails and body rails interengage beneath the drawer base via the guide rollers.

Since the guiding system is located under the base of the draw, it possesses the advantage that it can be concealed, and can provide maximum space utilization of the drawer, relatively great strength, and ease of adjustment.

1 Claim, 3 Drawing Sheets

UNDER-BASE GUIDING SYSTEM FOR A DRAWER

BACKGROUND OF THE INVENTION

The invention relates to a guiding system for a drawer of a piece of furniture such as a chest, the body of the piece of furniture being provided with sidewalls, a front batten, and rails having guide rollers, and the drawer being provided with rails having guide rollers.

A drawer guiding system of this nature is already known, wherein the chest rails were fastened on the internal side of the body of a chest, and the drawer rails were fastened on the external sides of the associated drawer sidewalls, i.e. the chest rails were fastened on the chest, laterally of the drawer, by means of lateral connectors.

The disadvantages possessed by such a known guiding system was that the rail guiding system was visible at the sides when the drawer was withdrawn, which is considered to be undesirable in many cases.

Furthermore, the rails of such a known system which were installed laterally on the chest were stressed in that they were subject to a high moment, which could adversely affect the guiding qualities of the rails. The known guide rails also had only a low degree of rigidity.

Moreover, the lateral gap between the drawer and the chest was a drawback, because this resulted in less usable space being available in the drawer.

The known guide rails could, moreover, only be adjusted with difficulty.

It is a primary object of the invention to provide a drawer guiding system which is capable of effectively avoiding the latter disadvantages, and enables a concealed drawer-guiding system to be achieved, together with a maximum space utilisation of the drawer coupled with increased strength and ease of adjustment.

BRIEF SUMMARY OF THE INVENTION

The problem is successfully resolved by arranging the rails of the piece of furniture under the base of the drawer, and securing the latter rails to the front and rear of the piece of furniture by front and rear connectors respectively, and by engaging the latter rails with the drawer rails beneath the drawer base, via guide rollers.

Thus, the installation of the rails is now performed beneath the drawer base instead of laterally of the drawer, the rails of the piece of furniture being fastened on or to a front batten or the like of the body of the piece of furniture, and on or to the rear side or wall of the body, beneath the drawer.

This has the complementary result of increasing the rigidity of the system as compared with guiding systems which are attached to the sidewalls.

Furthermore, the under-base guiding system embodying the invention does not require any spacing with respect to lateral fastening points, so that greater loads may be accomodated.

In the under-base system embodying the invention, a satisfactory lateral adjustment may also be achieved, since the chest or body rails may easily be displaced in slots or elongated sockets on the front batten and rear side of the body.

A section or unit containing a framing aperture may therefore be positioned in a relatively simple manner around the drawer, extending from the sidewalls of the chest or body.

Preferably, the front connector comprises a plate to which the chest or body rail is secured, for example by spot welds, and the rear connector comprises an angled plate which is fastened to the rear side or wall of the chest or body.

In one embodiment, the drawer rails comprises a vertical screw-on plate, and a horizontal engagement or locating surface for engagement by the lower extremity of the sidewall of the drawer.

The drawer rail is preferably provided, at its rear extremity, with an angled lug which engages over the rail of the chest or body.

Preferably, the front and/or rear connectors each comprise an angle plate or panel incorporating slots, to allow displacement, and therefore adjustment, of the guide rail in the slots.

One embodiment of the invention will now be described with reference to the accompanying drawings.

DETAILED DESCRIPTION OF THE PREFERRED EMBODIMENT

Figure 1:
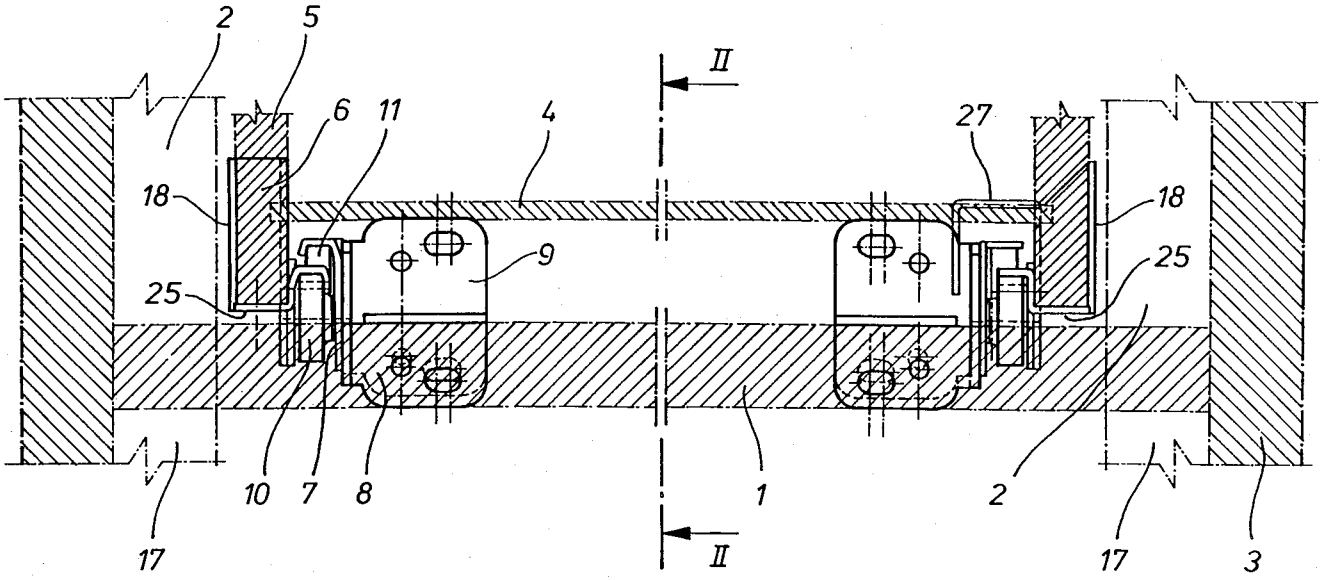
FIG. 1 is a front view, partly in section, of an under-base guiding system embodying the invention.

Referring to FIG. 1, the front of the body of a piece or unit of furniture, such as a chest of drawers, is formed by or provided with a front batten 1, which is joined to the chest sidewalls 3 via front cross-members 2. The front batten 1 and the front cross-members 2 consequently extend precisely at right angles to each other and form a frame-like structure.

The front of each sidewall 3 of the chest is covered by a framing aperture section 17, the opening left clear between the two mutually opposed, lateral framing aperture sections 17 movably receiving the drawer. The drawer in this embodiment comprises a drawer base 4 which is covered or closed at the front in a known manner by a drawer cover (not shown).

Figure 4:
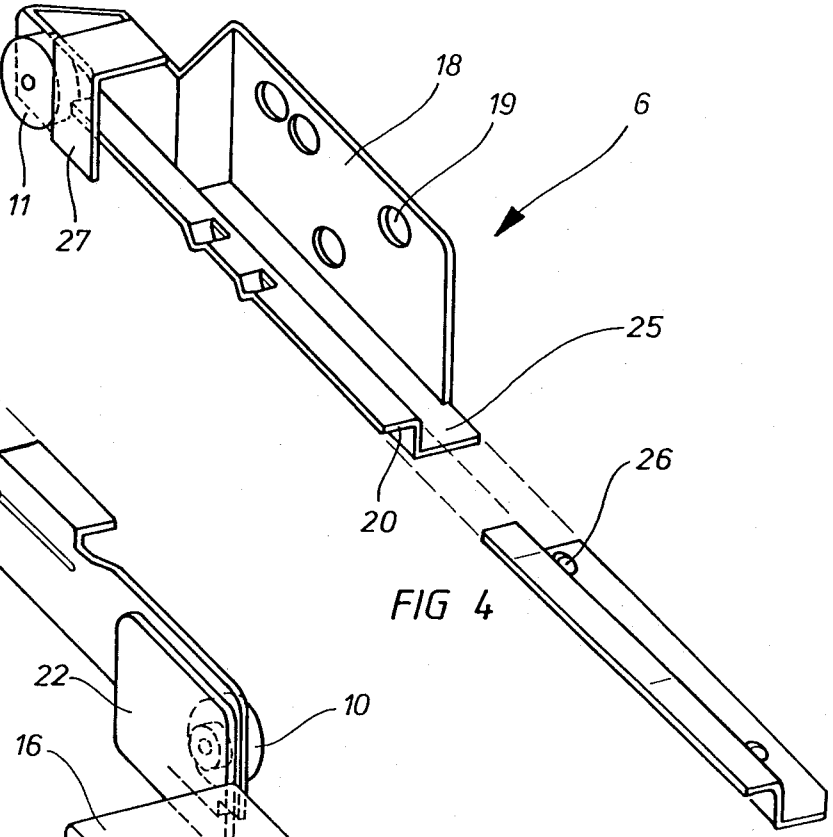
FIG. 4 is a perspective view of one of the guide rails which is to be attached to the drawer.

The drawer base 4 is joined to sidewalls 5, each sidewall being provided on its inwardly facing side, below the base 4, with a drawer runner or rail 6. The drawer rail 6 has the configuration shown in FIG. 4, and comprises a lateral screw-on plate 18 (see FIG. 4) having apertures or bores 19 through which screws (not shown) pass which serve to join the plate 18 to the corresponding sidewalls 5 of the drawer.

The drawer rail is thus fastened in this manner to the sidewalls 5 as shown in FIG. 1.

To the rear portion of each drawer rail 6 is fixed a rotatable guide roller 11, and a guide track 20 extends forwardly from the roller 11. The track 20 acts as a bearer for a similar guide roller 10 rotatably fixed to the front portion of a corresponding chest runner or rail 7.

Figure 2:
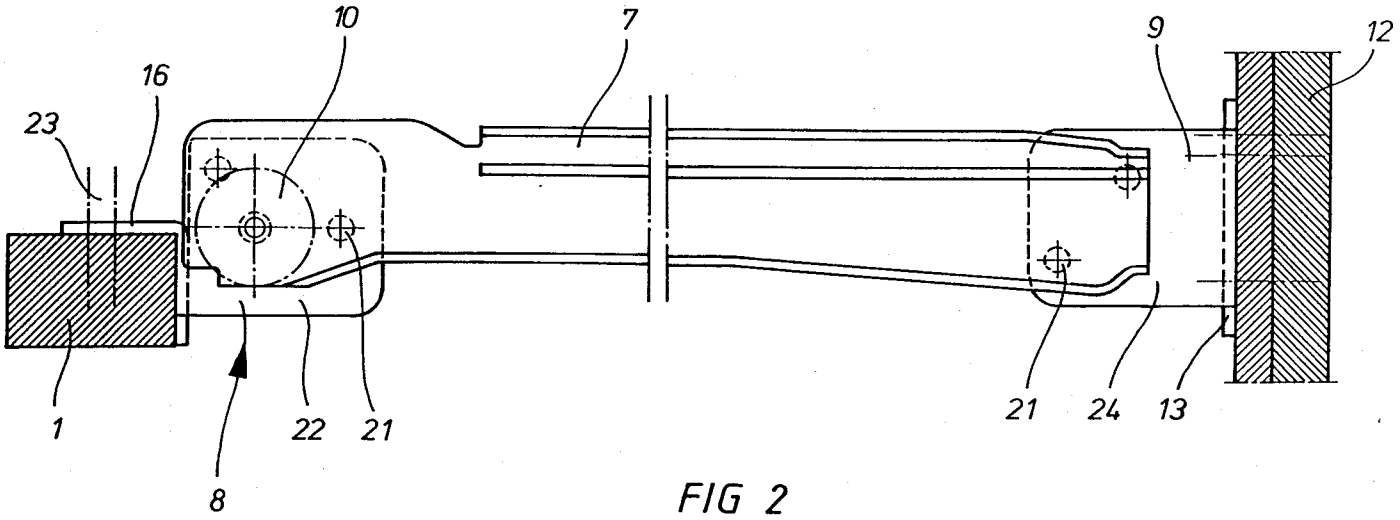
FIG. 2 is a cross-section on the line II—II in FIG. 1.
Figure 3:
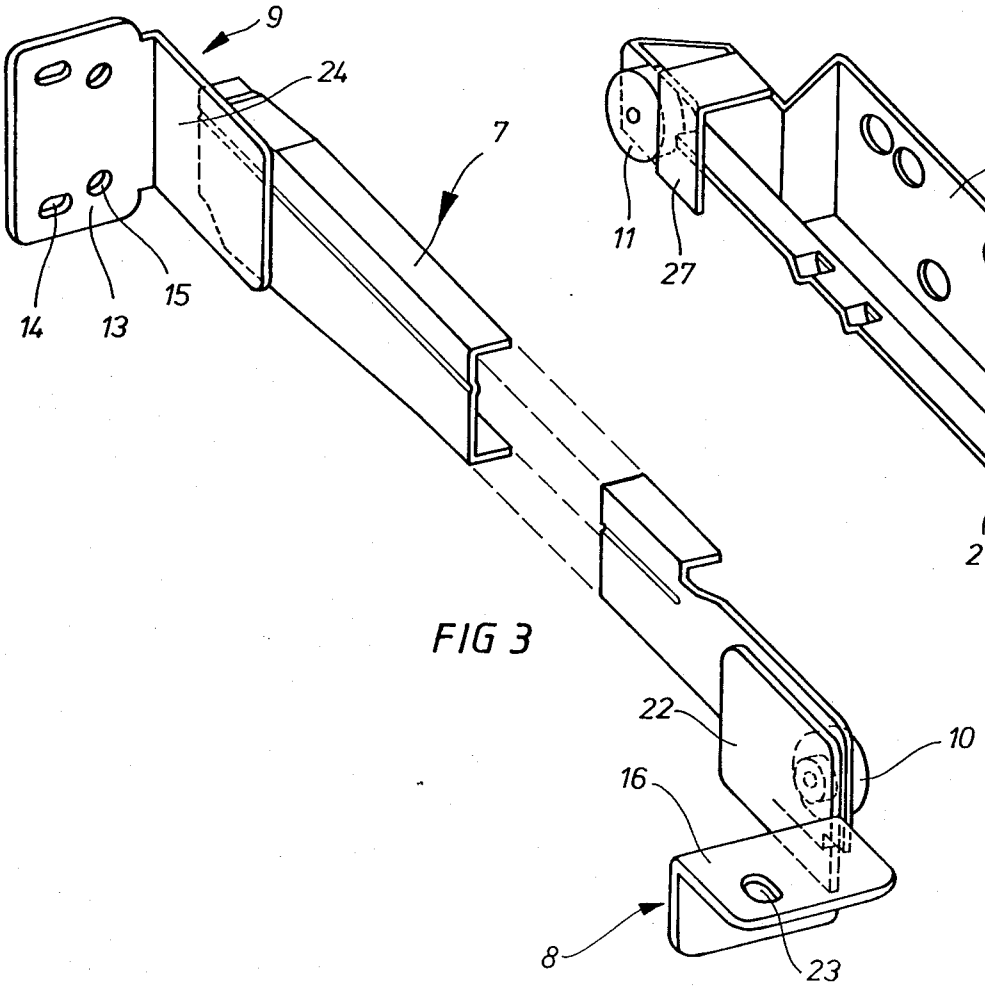
FIG. 3 is a perspective view of one of the rails which is to be attached to the piece of furniture.

Each chest rail 7 is joined to the front batten 1 via a front connector 8, and to the rear side or wall 12 of the chest via a rear connector 9, as shown in FIGS. 2 and 3.

The novelty of the present invention resides in that the customary lateral connectors situated on the sidewalls of the body of the chest are eliminated, and use is made instead of front connectors 8 and rear connectors 9 which are connected to, and carry, the chest rails 7.

The method of fastening the chest rails to the body of the chest will be apparent from FIGS. 2 and 3.

In this respect, the front portion of the chest rail 7 is joined to the front connector 8 via appropriate spot welds 21 which are situated in the area of a plate 22. The plate 22 is joined to an angle plate 16 having appropriate apertures or bores 23 for receiving mounting screws (not shown) which are screwed into the front batten 2.

The fastening of the rear portion of the chest rail 7 is effected by the rear connector 9 illustrated in FIGS. 2 and 3. This rear connector 9 comprises an elongate plate 24 which is joined via appropriate spot welds 21 to the rear extremity of the chest rail 7. The elongate plate 24 is joined via an angled portion to a plate 13 which is disposed parallel to and against the rear side or wall 12 of the chest, and which has apertures or bores 14, 15 for receiving appropriate mounting screws which are screwed into the rear wall 12 to join the plate 13 thereto.

It is also of importance that the drawer sidewalls 5 bear against the inwardly directed sides of the screw-on plates 18, and that the lower ends of these sidewalls 5 rest on an engagement or support surface 25 of the drawer rail 6 as shown in FIG. 1. As a result, it is possible for the screws which are screwed into the drawer sidewalls 5, for example at one or both ends of the sidewalls or elsewhere, to be inserted from beneath via apertures or bores 26. This results in a particularly advantageous and reliable fastening, because the drawer sidewalls are simultaneously also secured to the guide rails 6 via screws which engage in the apertures 19 in the screw-on plates 18.

The rear portion of the drawer rails 6 have lateral angled lugs 27 which engage over the rear portion of the chest rails 7, so that a level guiding action is achieved between the drawer rails 6 and chest rails 7.

I claim:

1. An under-base guiding system for a drawer of a piece of furniture, the piece of furniture having a body provided with side walls, a rear, a front, and rails having guide rollers, and the drawer being provided with a base, and rolls having guide rollers, wherein the body rails are situated beneath the drawer base, and are each fastened to the body adjacent by front connector means and to the body adjacent the rear by rear connector means, and the drawer rails engage the body rails under the drawer base via the guide rollers, the front connector means comprises plates to which the body rails are secured by spot welds, the front connector means also comprising angled plates which are fastened to a front batten of the body, the rear connector means comprising elongate plates to which the body rails are secured by spot welds, the rear connector means also comprising angled plates which are fastened to the rear of the body, the angled plates of the front and rear connector means are provided with slots for receiving means to adjustably anchor the front and rear connector means to the furniture body, each drawer rail has a generally vertical screw-on plate and a generally horizontal engagement surface for the lower extremity of the associated drawer sidewall, and the drawer rails have an overlapping lug proximate the vertical screw-on plate and rearward of the drawer base.

* * * * *